US008471874B2

(12) United States Patent
Sato et al.

(10) Patent No.: US 8,471,874 B2
(45) Date of Patent: Jun. 25, 2013

(54) ELECTRO-OPTICAL DEVICE, IMAGE PROCESSING DEVICE, AND ELECTRONIC APPARATUS

(75) Inventors: Shigemi Sato, Asahi-mura (JP); Hidehito Iisaka, Shiojiri (JP); Hiroyuki Hosaka, Matsumoto (JP); Takashi Toyooka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1182 days.

(21) Appl. No.: 11/752,531

(22) Filed: May 23, 2007

(65) Prior Publication Data

US 2007/0273628 A1 Nov. 29, 2007

(30) Foreign Application Priority Data

May 26, 2006 (JP) ..... 2006-146427

(51) Int. Cl.
*G09G 5/10* (2006.01)

(52) U.S. Cl.
USPC ..... 345/690; 345/87; 345/88; 345/204; 345/89; 345/205

(58) Field of Classification Search
USPC ..... 345/87–104, 204
See application file for complete search history.

(56) References Cited

U.S. PATENT DOCUMENTS

| | | | | |
|---|---|---|---|---|
| 7,280,103 | B2 | 10/2007 | Taoka et al. | |
| 2004/0114396 | A1 * | 6/2004 | Kobayashi et al. | 362/561 |
| 2004/0155847 | A1 * | 8/2004 | Taoka et al. | 345/87 |
| 2005/0253785 | A1 | 11/2005 | Miyasaka et al. | |
| 2006/0033445 | A1 * | 2/2006 | Kim et al. | 315/169.3 |
| 2006/0044472 | A1 * | 3/2006 | Lee et al. | 348/607 |
| 2006/0125841 | A1 | 6/2006 | Toyooka | |
| 2006/0256141 | A1 | 11/2006 | Maruyama et al. | |

FOREIGN PATENT DOCUMENTS

| | | |
|---|---|---|
| JP | A-3-251818 | 11/1991 |
| JP | A 2003-050569 | 2/2003 |
| JP | A-2004-240317 | 8/2004 |
| JP | A 2005-164937 | 6/2005 |
| JP | A 2006-189824 | 7/2006 |
| JP | A-2006-259619 | 9/2006 |
| JP | A-2006-259624 | 9/2006 |
| JP | A-2006-343707 | 12/2006 |

* cited by examiner

*Primary Examiner* — Grant Sitta
(74) *Attorney, Agent, or Firm* — Oliff & Berridge, PLC

(57) ABSTRACT

An electro-optical device includes a display unit that has a plurality of pixel portions constituting a display area on a substrate and an image signal processing. The image signal processing circuit generates an image signal that sets a first subframe frame luminance of the pixel portion in a first subframe and sets a second subframe luminance of the pixel portion in a second subframe. The first subframe and the second subframe are obtained by partitioning a first frame of a first frame image signal. The first frame has a frame luminance. The first subframe luminance is higher than the frame luminance and the second subframe luminance is lower than the frame luminance.

5 Claims, 9 Drawing Sheets

ELECTRO-OPTICAL DEVICE, IMAGE PROCESSING DEVICE, AND ELECTRONIC APPARATUS

CROSS-REFERENCE TO RELATED APPLICATION

This application claims priority from Japanese Patent Application No. 2006-146427 filed in the Japanese Patent Office on May 26, 2006, the disclosure of which is hereby incorporated by reference in its entirety.

BACKGROUND

1. Technical Field

Embodiments of the invention relate to the technical field of electro-optical devices, such as liquid crystal devices, image processing circuits applied to the electro-optical devices, and electronic apparatuses, such as liquid crystal projectors, including the electro-optical devices.

2. Related Art

In electro-optical devices such as liquid crystal devices that display images in a hold mode, a residual image is strikingly perceived by human vision in the case that a moving image is displayed, compared with display devices such as cathode ray tubes (CRTs) that display images in an impulse mode. Therefore, blur of a moving image often occurs in that the edge of a moving object image within the displayed image seems unclear JP-A-2003-50569 discloses an exemplary technique to reduce such moving image blur.

However, according to the technique disclosed in JP-A-2003-50569, the entire display screen becomes dark. This technical problem is that, although blur of the moving image is reduced, the luminance of each pixel displaying the image must be sacrificed.

SUMMARY

Embodiments include an electro-optical device that reduces blur of a moving image without reducing the brightness of the entire image, an image processing circuit applicable to such an electro-optical device, and an electronic apparatus.

An electro-optical device according to embodiments includes a display unit that has a plurality of pixel portions constituting a display area on a substrate; and an image signal processing circuit that generates an image signal that sets, in the case that luminance to be displayed by each of the pixel portions on the basis of an image signal in a first frame is first luminance, the luminance of the pixel portion in a first subframe of subframes obtained by dividing the first frame to high luminance, which is higher than the first luminance, and sets the luminance of the pixel portion in a second subframe of the subframes of the first frame to low luminance, which is lower than the first luminance.

According to embodiments of an electro-optical device, the display unit is a liquid crystal panel having, for example, liquid crystal serving as an exemplary electro-optical material sandwiched between a pair of substrates. The display unit includes a plurality of pixel portions, each having an element such as a thin-film transistor (TFT) and a pixel electrode. By arranging the pixel portions in a plane, a display area is formed.

According to embodiments of an electro-optical device, in the case that frame images corresponding to a plurality of frames constituting a series of frames for displaying, for example, a moving image are displayed at a frame cycle of 60 Hz, subframe images corresponding to first and second subframes obtained by dividing each frame are displayed in the first and second subframes. The subframe images can be displayed by the so-called double-speed display operation.

In the case that the frame images are displayed in the display area without any processing, for example, among the plurality of pixel portions, the luminance of each pixel portion located at a position corresponding to the edge of a moving object image within the moving image displayed in the display area changes greatly between adjacent frames, thereby causing blur of the moving image. If a black image as displayed as a frame image to be displayed by the pixel portion in one of the adjacent frames to reduce such blur of the moving image, the luminance of the pixel portion is sacrificed. As a result, the brightness of the moving image composed of the frame images within a series of frames is relatively reduced.

According to embodiments of an electro-optical device, the image signal processing circuit generates an image signal that sets, in the case that luminance to be displayed by each of the pixel portions on the basis of an image signal in a first frame is first luminance, the luminance of the pixel portion in a first subframe of subframes obtained by dividing the first frame to high luminance, which is higher than the first luminance, and sets the luminance of the pixel portion in a second subframe of the subframes of the first frame to low luminance, which is lower than the first luminance. In other words, unlike a display method of displaying a black image on a frame-by-frame basis to reduce moving image blur, an image with luminance lower than the first luminance is displayed on a subframe basis, thereby preventing the brightness of an image displayed in the display area from being reduced. In this case, the "high luminance" and the "low luminance" are higher and lower than the first luminance, which is the luminance of the pixel portion set in accordance with a frame image to be displayed in the original frame. In the case that, for example, the period of each of the first and second subframes is set to half the frame period, the luminance of the pixel portion in the first subframe is set to the high luminance, and the luminance of the pixel portion in the second subframe is set to the low luminance, thereby averaging the luminance of the pixel portion in the entire frame period when perceived by human eyes. As a result, the brightness of the frame image can be maintained.

The image signal processing circuit generates image signals corresponding to subframe images to be displayed in the subframes on the basis of an image signal supplied in accordance with a frame cycle and various signals including a synchronization signal and supplies the generated image signals to the display unit, such as a liquid crystal panel.

In this manner, not only the darkest displayable image or black image can be displayed in the display area, but also a dark image, such as a dark gray image or a gray image, can be displayed in accordance with luminance lower than the first luminance, which is as low as possible so long as a residual image can be reduced. The image signal processing circuit sets, among the plurality of pixel portions, the pixel portions corresponding to the position of the edge of the above-described moving object image, the pixel portions arranged in a line in display area, or all the pixel portions to the low luminance in the second subframe, thereby displaying a dark image. By displaying such a dark image in the second subframe by the pixel portions, blur of the moving image can be reduced significantly. More specifically, within an area where the luminance of each pixel portion changes, the width of an area interpolated by human eyes, that is, the width of an area serving as the direct cause of the moving image blur, can be narrowed.

According to embodiments of an electro-optical device, even in the case of a display operation performed in the hold mode, the brightness of a moving image can be maintained, and, at the same time, blur of the moving image can be reduced, which have been difficult to achieve using a known display method. Therefore, a high-quality moving image can be displayed.

In this case, the image signal processing circuit may include the following elements: a storage unit that stores the first luminance and second luminance to be displayed in a second frame that precedes or follows the first frame; a comparator that compares the first luminance with the second luminance, the first luminance and the second luminance being stored in the storage unit; and a determination unit that determines whether the difference between the first luminance and the second luminance is greater than or equal to a predetermined threshold. In this case, the image signal processing circuit may generate the image signal by setting the high luminance and the low luminance to, among the pixel portions, a predetermined pixel portion in which the difference between the first luminance and the second luminance is greater than or equal to the predetermined threshold.

According to embodiments, the storage unit stores the first luminance and the second luminance for, among the plurality of pixel portions constituting the display area, pixel portions constituting a predetermined area, all the pixel portions, or pixel portions set in advance for which the luminance in both of the first and second frames is to be obtained. The first luminance and the second luminance are luminance to be displayed in the first frame and the second frame, respectively, by a pixel portion in the case that images are displayed on a frame-by-frame basis. The storage unit including frame memories or the like stores image signals supplied corresponding to the first luminance and the second luminance, that is, data corresponding to voltages applied to the electro-optical material, such as liquid crystal, in accordance with the image signals.

The determination unit determines whether the difference between the first luminance and the second luminance compared by the comparator is greater than or equal to the predetermined threshold. The "predetermined threshold" is a reference value for determining, for example, whether blur of a moving image is recognized or not. For example, in the liquid crystal device, an exemplarily predetermined threshold is about 10% of the maximum voltage applied to liquid crystal held between a pixel electrode of each pixel portion and a counter electrode. Needless to say, such a threshold can be set on the basis of the type of liquid crystal serving as an exemplary electro-optical material, that is, the relative relationship between the applied voltage and the alignment state of the liquid crystal. In addition, the predetermined threshold is set taking into consideration the tolerance of moving image blur or the degree of desired reduction in blur of a moving image.

The image signal processing circuit generates the image signal by setting the high luminance and the low luminance to, among the plurality of pixel portions, a predetermined pixel portion in which the difference between the first luminance and the second luminance is greater than or equal to the predetermined threshold. Among the plurality of pixel portions, a pixel portion in which the difference between the first luminance and the second luminance is greater than or equal to the predetermined threshold is a pixel portion displaying the edge of the moving object image within the frame images displayed in the first and second frames. By setting the high luminance and the low luminance to such a pixel portion, the luminance of the frame images can be maintained, and blur of the moving image can be reduced.

In this case, an image signal supplied to the image signal processing circuit may be a color image signal including red (R), green (G), and blue (B) color component signals, and the comparator may be provided for each of the R, G, and B color component signals included in the color image signal.

According to embodiments, blur of a moving image caused by a change in luminance of a specific one(s) of the R, G, and B light components can be reduced. The comparator compares luminance levels (i.e., the first luminance and the second luminance) of each pixel portion in accordance with the R, G, and B color component signals in the first and second frames. According to the aspect of the invention, even in the case that the luminance of each pixel portion in accordance with the R, G, and B light changes on a frame-by-frame basis, blur of a moving image caused by such a change can be reduced.

It is preferable that, in the case that the difference between the first luminance and the second luminance regarding at least one of the R, G, and B color component signals is greater than or equal to the predetermined threshold, the image signal processing circuit set the high luminance and the low luminance to the predetermined pixel portion regarding all the R, G, and B color component signals.

According to the aspect of the invention, blur of the moving image can be reduced. In addition, by setting the high luminance and the low luminance to the predetermined pixel portion regarding color light whose difference between the first luminance and the second luminance is greater than or equal to the predetermined threshold, the occurrence of a color shift induced in each frame image displayed in the image display area can be reduced.

Alternatively in this case, the high luminance and the low luminance may be set to the predetermined pixel portion regarding, among the R, G, and B color component signals, a color component signal in which the difference between the first luminance and the second luminance is greater than or equal to the predetermined threshold.

According to embodiments, blur of the moving image caused in accordance with the frame images to be displayed in the first and second frames can be reduced more or less.

Alternatively, it is preferable that, in the case that the difference between the first luminance and the second luminance regarding at least one of the R, G, and B color component signals is greater than or equal to the predetermined threshold, the image signal processing circuit set the high luminance and the low luminance to the predetermined pixel portion regarding the remaining color component signals excluding the at least one color component signal.

According to embodiments, blur of the moving image caused by a change in luminance regarding color light corresponding to the remaining color component signals can be reduced.

It is preferable that the image signal processing circuit include the following elements: a storage unit that stores an image signal of a frame image to be displayed in the first frame and an image signal of a frame image to be displayed in a second frame that precedes or follows the first frame; and a motion detector that detects, on the basis of the image signals, motion of a moving object image displayed in the display area in a series of frames including the first and second frames. In this case, the image signal processing circuit may generate the image signal for, among the pixel portions, a pixel portion in which the motion of the moving object image has been detected by the motion detector.

According to embodiments, the motion detector can detect the motion of the moving object image within the frame images using, for example, a known motion detection method. The image signal processing circuit generates the image signal for a pixel portion in which the motion of the moving object image has been detected by the motion detector on the basis of the detection result (that is, a pixel portion corresponding to the edge of the moving object image). Accordingly, blur of the moving image can be reduced, as in the case of using the above-described comparator.

It is preferable that the image signal processing circuit include a signal correction unit that outputs corrected image signals to the display unit, the corrected image signals being obtained by correcting image signals corresponding to the high luminance and the low luminance, respectively.

According to embodiments, the signal correction unit can correct image signals corresponding to the high luminance and the low luminance, respectively, by referring to, for example, a gamma table. Accordingly, the number of bits of image signals can be reduced, compared with the case in which image signals are corrected by the image signal processing circuit.

An image processing circuit according to some embodiments includes an image signal processing circuit that generates an image signal that sets, in a display area of a display unit including a plurality of pixel portions arranged on a substrate, in the case that luminance to be displayed by each of the pixel portions on the basis of an image signal in a frame is first luminance, the luminance of the pixel portion in a first subframe of subframes obtained by dividing the frame to high luminance, which is higher than the first luminance, and sets the luminance of the pixel portion in a second subframe of the subframes of the frame to low luminance, which is lower than the first luminance; and a driver that drives the display unit in accordance with image signals corresponding to the first subframe and the second subframe, respectively.

According to embodiments of an image processing circuit, the driver includes, for example, a scanning-line drive circuit and a data-line drive circuit for driving the display unit in accordance with the image signals corresponding to the high luminance and the low luminance, respectively. According to embodiments of an image processing circuit, blur of a moving image can be reduced, as in the above-described electro-optical device, and the brightness of each frame image can be maintained.

An electronic apparatus according to some embodiments includes the above-described electro-optical device.

Since embodiments of an electronic apparatus include the above-described embodiment of an electro-optical device, various electronic apparatuses that can display high-quality images, such as projectors, cellular phones, digital diaries, word-processors, viewfinder-type or monitor direction-view type videotape recorders, workstations, videophones, point-of-sale (POS) terminals, and apparatuses equipped with a touch panel, can be implemented. In addition, an electrophoretic device, such as electronic paper, can be implemented as an embodiment of an electronic apparatus.

The features and advantages of the invention will become apparent from the following description of exemplary embodiments.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Embodiments of the invention will be described on the basis of the drawings. In the following description, an electro-optical device according to the embodiments of the invention is applied to a liquid crystal device in a TFT active matrix drive mode.

Structure and Operation of Electro-Optical Device

Figure 1:
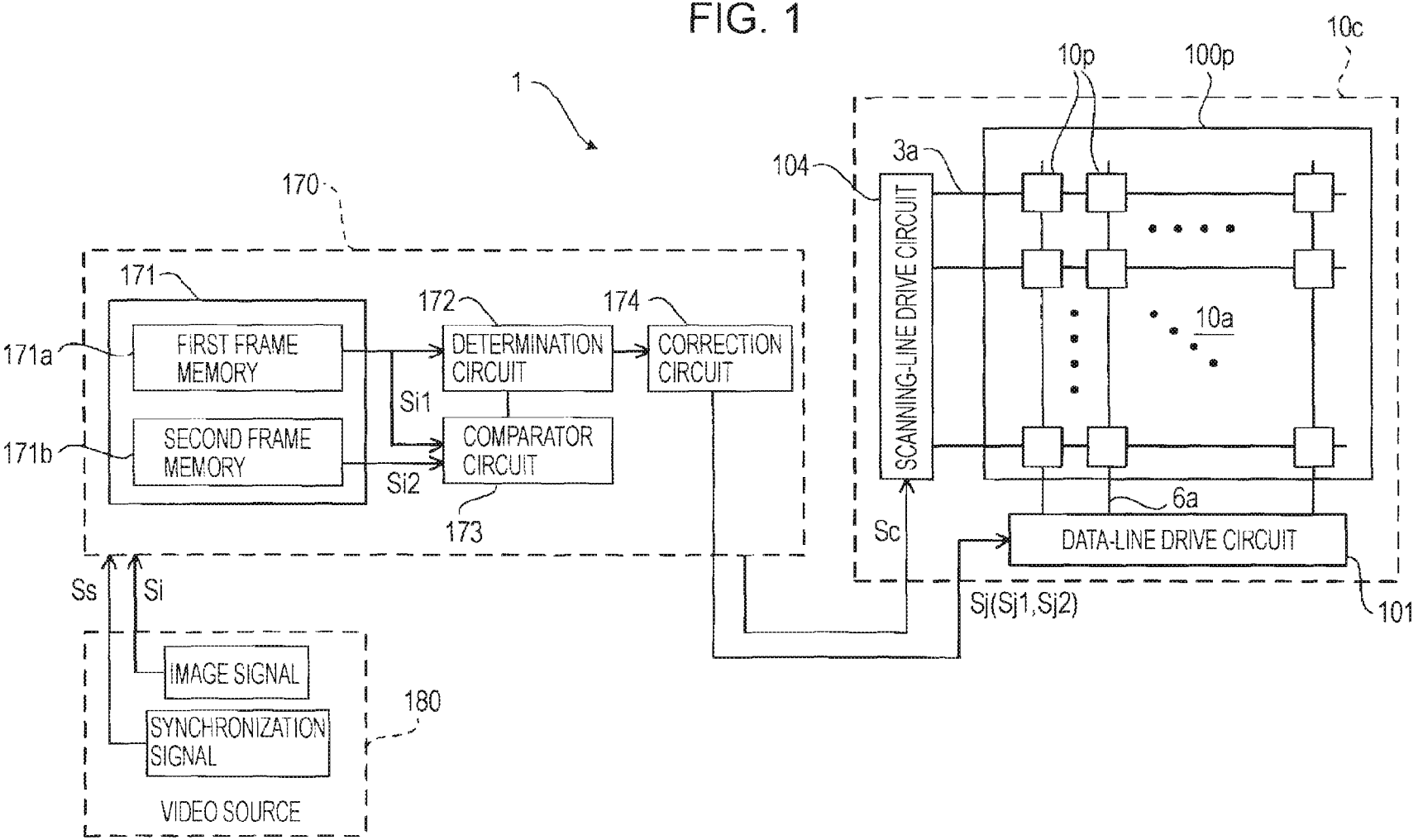
FIG. 1 is a block diagram of a liquid crystal device serving as an electro-optical device according to an embodiment of the invention.
Figure 2:
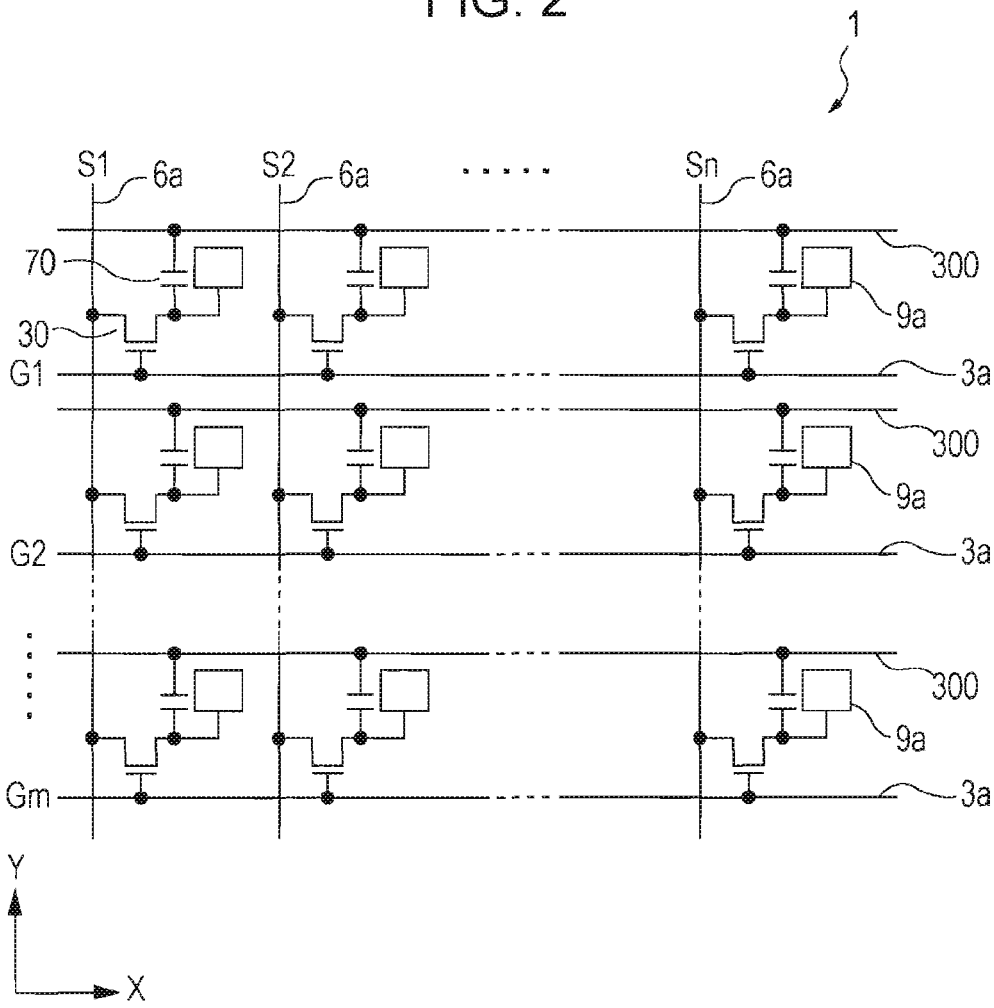
FIG. 2 is an equivalent circuit diagram of various elements and lines in a plurality of pixel portions of an image display area.

With reference to FIGS. 1 and 2, the structure and operation of the entirety of a liquid crystal device 1 according to an embodiment of the invention will be described. FIG. 1 is a block diagram of the liquid crystal device 1, and FIG. 2 is an equivalent circuit diagram of various elements and lines in a plurality of pixel portions arranged in a matrix constituting an image display area serving as a display area of the liquid crystal device 1.

Referring to FIG. 1, the liquid crystal device 1 includes a display unit 10*e* and an image signal processing circuit 170. The image signal processing circuit 170 includes a storage circuit 171, a determination circuit 172, a comparator circuit 173, and a correction circuit 174. An image signal Si and a synchronization signal Ss are input from a video source 180 to the image signal processing circuit 170. The display unit 10*c* includes a liquid crystal panel 100P, a scanning-line drive circuit 104, and a data-line drive circuit 101.

Referring to FIG. 2, the liquid crystal panel 100P includes a plurality of pixel portions 10*p* arranged in a planar matrix in an image display area 10*a*. Pixel electrodes 9*a* and TFTs 30 for switching on and off the corresponding pixel electrodes 9*a* are formed in the corresponding pixel portions 10*p* on the liquid crystal panel 100P. Data lines 6*a* to which image signals are supplied are electrically connected to the sources of the TFTs 30. Image signals S1, S2, . . . , and Sn written to the data lines 6*a* may be line-sequentially supplied in this order or may be supplied to each group of the adjacent data lines 6*a*.

Gate electrodes are electrically connected to the gates of the TFTs 30, and scanning signals G1, G2, . . . , and Gm are line-sequentially applied in this order as pulses to scanning lines 3*a* and the gate electrodes. The pixel electrodes 9*a* are electrically connected to the drains of the corresponding TFTs 30. By closing the TFTs 30 serving as switching elements for a predetermined period, the image signals S1, S2, . . . , and Sn supplied via the data lines 6*a* are written at a predetermined timing.

The image signals S1, S2, . . . , and Sn at predetermined levels, which are written to liquid crystal serving as an exemplary electro-optical material via the pixel electrodes 9*a*, are held for a predetermined period between the pixel electrodes 9*a* and a counter electrode formed on a counter substrate. The liquid crystal can modulate light and display a tone level by changing the alignment and order of a molecular assembly in response to the level of an applied voltage. In the case of a normal white mode, the transmittance of incident light decreases in accordance with a voltage applied to each pixel. In the case of a normally black mode, the transmittance of incident light increases in accordance with a voltage applied to each pixel. As a result, the overall liquid crystal device 1 emits light with a contrast in accordance with each image signal.

To prevent the held image signals from leaking, storage capacitors 70 are added parallel to liquid crystal capacitors formed between the pixel electrodes 9*a* and the counter electrode. The storage capacitors 70 are disposed along the scanning lines 3*a*. The storage capacitors 70 include capacitor electrodes 300 which include fixed-potential capacitor electrodes and which are fixed at a constant potential.

Referring back to FIG. 1, the scanning-line drive circuit 104 supplies the scanning signals G1, G2, . . . , and Gm to the scanning lines 3*a* at a predetermined timing (see FIG. 2), as has been described above, and the data-line drive circuit 101 supplies the image signals S1, S2, . . . , and Sn to the data lines 6*a* (see FIG. 2), as has been described above. The data-line drive circuit 101 includes, for example, a sampling circuit that samples the image signals S1, S2, . . . , and Sn supplied to image signal lines, a shift register that supplies a sampling pulse to the sampling circuit, and the like.

On the basis of the image signal S1 and the synchronization signal Ss input from the video source 180, such as a digital versatile disc (DVD) video player, a video recorder, or a video tuner, the image signal processing circuit 170 supplies various signals Sc serving as references for the scanning-line driving, such as a clock signal (Y clock), an inverted clock signal, a start pulse signal (Y start pulse) serving as a reference for the scan start, and a power source signal, to the scanning-line drive circuit 104, thereby driving the scanning-line drive circuit 104. In addition, the image signal processing circuit 170 supplies various signals serving as references for the data line driving, such as a clock signal (X clock), an inverted clock signal, a start pulse signal (X start pulse) serving as a reference for the scan start, the image signals S1, S2, . . . , Sj, . . . , and Sn (see FIG. 2) supplied to the parallel-serial expanded data lines 6*a* by way of example, and a power source signal, to the data-line drive circuit 101, thereby driving the data-line drive circuit 101.

Figure 3:
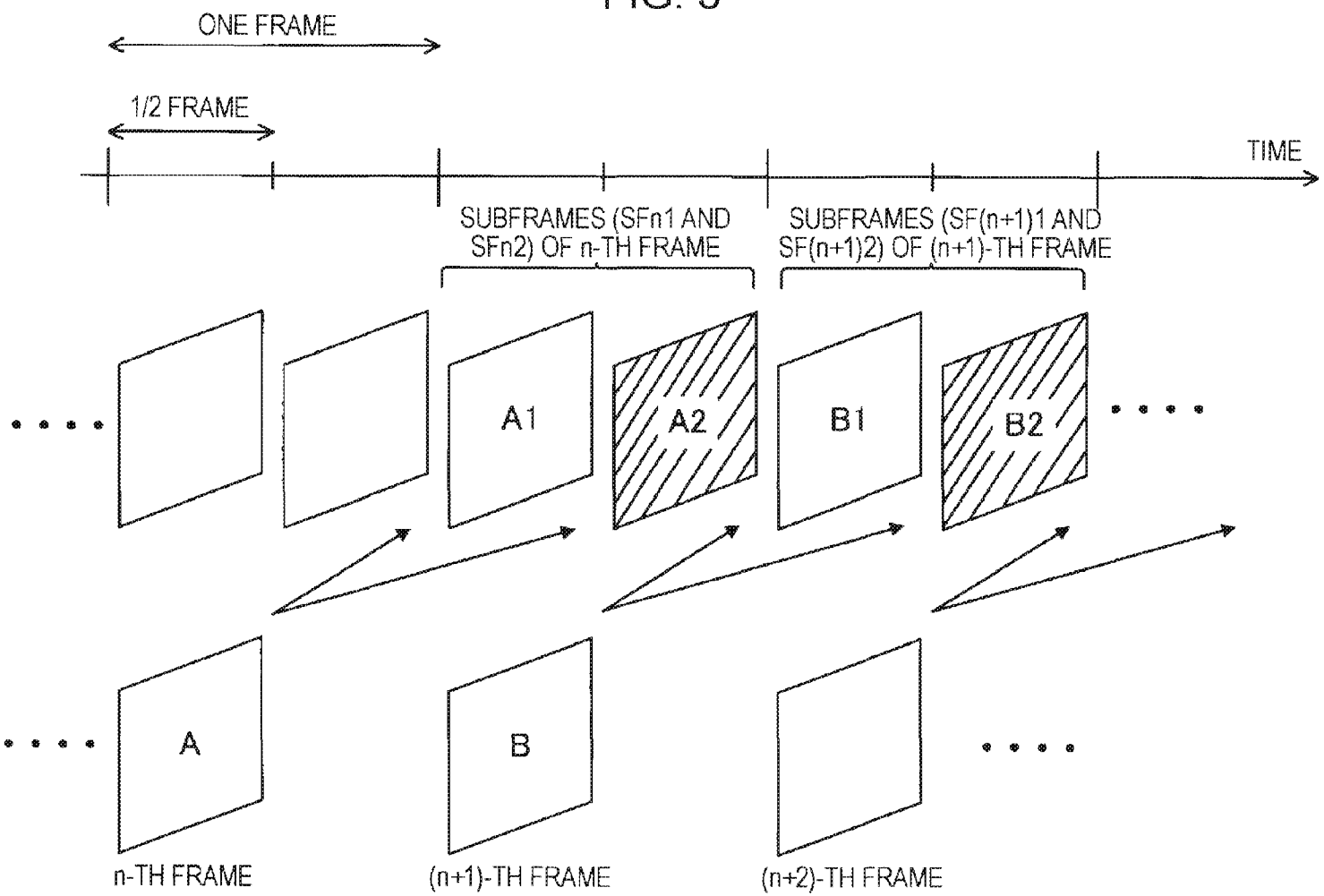
FIG. 3 is a conceptual diagram showing the relationship between frame images and subframe images constituting a moving image.
Figure 4:
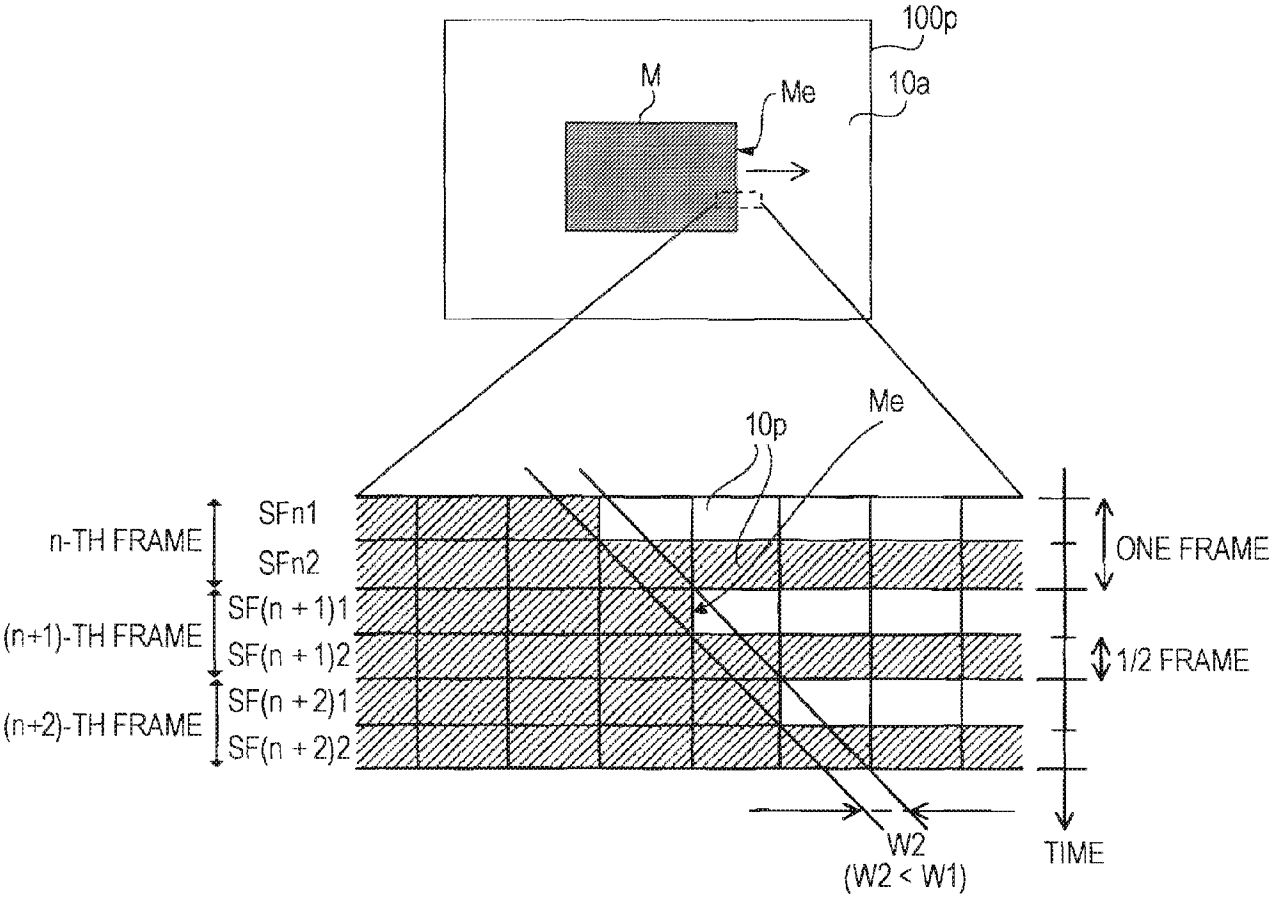
FIG. 4 is a schematic diagram showing the luminance of pixel portions constituting part of the image display area.
Figure 5:
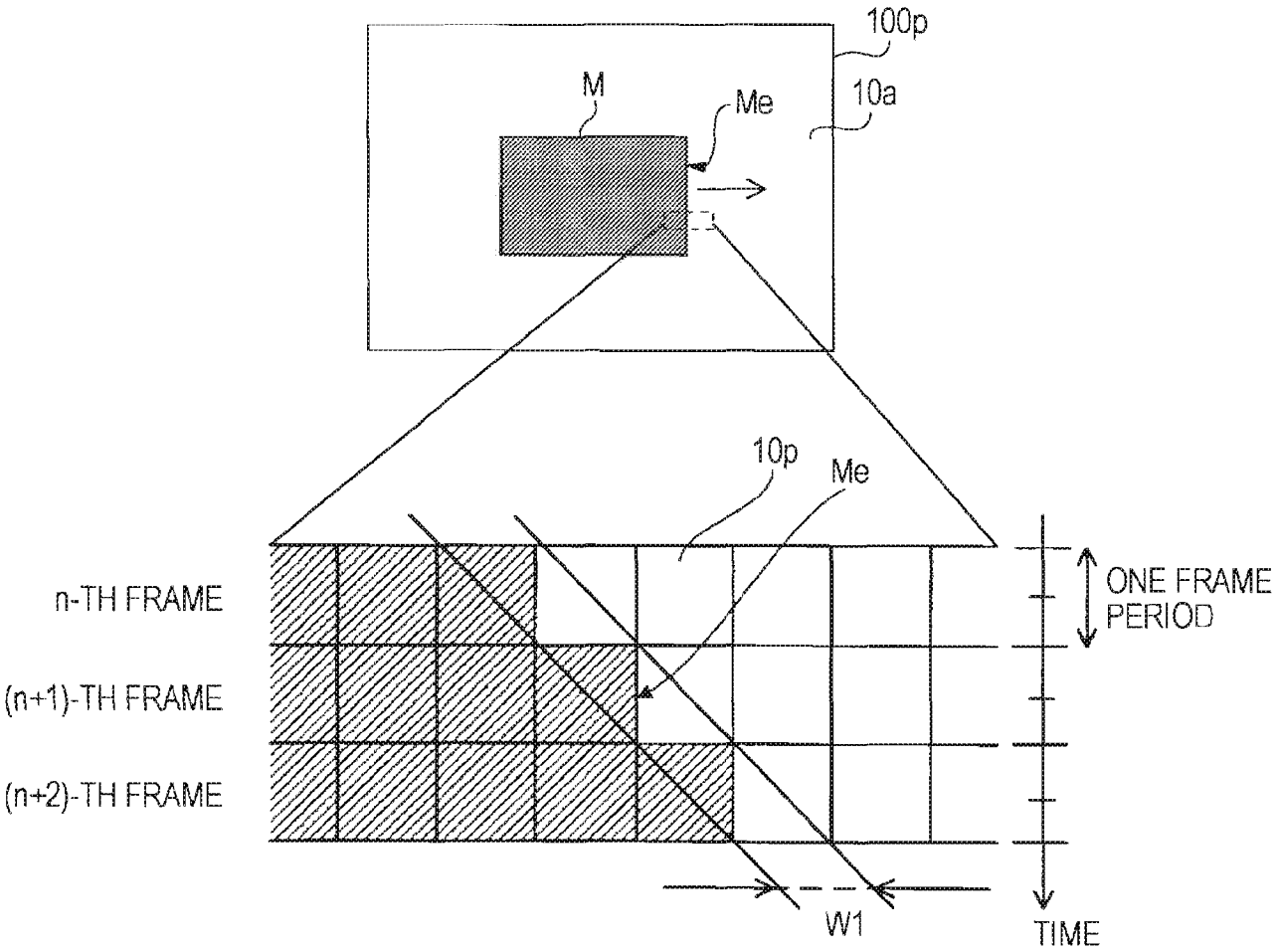
FIG. 5 is a diagram showing a comparative example corresponding to FIG. 4.

Next, with reference to FIGS. 1 to 6, the operation of the liquid crystal device 1 will be described in detail. FIG. 3 is a conceptual diagram showing the relationship between frame images and subframe images constituting a moving image displayed by the liquid crystal device 1. FIG. 4 is a schematic diagram showing the luminance of pixel portions constituting part of the image display area 10*a*. FIG. 5 is a diagram showing a comparative example corresponding to FIG. 4, FIG. 6 includes diagrams showing a luminance combination set to one pixel portion.

As shown in FIGS. 1 and 3, the image signal processing circuit 170 divides each of frame images A, B, . . . to be displayed by the display unit 10*c* in corresponding frames into two subframe images A1 and A2, B1 and B2, . . . such that the integral of the luminance in the subframes becomes the luminance of an image to be displayed in the original frame. According to the embodiment, on the basis of the image signal Si and various signals Sc supplied from the image signal processing circuit 170, the display unit 10*c* displays frame images to be displayed at a frame cycle of 60 Hz at a double speed and displays subframe images one at a time in a half frame. In other words, the image signal processing circuit 170 supplies the image signal Si and various signals Sc to the display unit 10*c* such that the display unit 10*c* can display a subframe image in one subframe and another subframe image in the other subframe, which are obtained by dividing one frame on a time-division basis.

More specifically, as shown in FIG. 3, the frame image A to be displayed in an n-th Frame in the image display area 10*a* is displayed as the subframe images A1 and A2 in subframes SFn1 and SFn2 of the n-th frame. In the case that the subframe image A2 is displayed, the luminance of each pixel portion 10*p* is set to be lower than that of each pixel portion 10*p* displaying the frame image A (that is, relatively darker than the luminance of each pixel portion 10*p* displaying the frame image A). In contrast, in the case that the subframe image A1 is displayed, the luminance of each pixel portion 10*p* is set to be higher than that of each pixel portion 10*p* displaying the frame image A (that is, relatively lighter than the luminance of each pixel portion 10*p* displaying the frame image A). By displaying a relatively dark image as a subframe image compared with a frame image to be displayed in the original frame in this manner, blur of a moving image is reduced, which will be described later with reference to FIGS. 4 and 5. In addition, since each pixel portion 10*p* displaying the subframe images A1 and A2 is set to high luminance and low luminance, respectively, the luminance of each pixel portion 10*p* displaying the subframe images A1 and A2 in the n-th frame is averaged, and the brightness of the entire image display area 10*a* can be maintained similar to the brightness in the case that the frame image A is displayed.

Referring to FIGS. 4 and 5, the reason that the moving image blur can be reduced and the frame image brightness can be maintained in the liquid crystal device 1 will be described in detail. FIGS. 4 and 5 show, for example, the case in which a moving object image M displayed in black moves from left to right within a moving image displayed in the image display area 10*a*. In FIGS. 4 and 5, each pixel portion 10*p* displaying black is indicated by slanted hatching.

As shown in FIG. 5, in the case that frame images are displayed in corresponding frame periods, namely, the n-th frame, (n+1)-th frame, and (n+2)-th frame, an edge Me of the moving object image M is defined by a stepped portion defined by the pixel portions 10*p* sequentially displaying black on a frame-by-frame basis. In the case that the edge Me, which is the stepped portion defined by the pixel portions 10*p* displaying black, is viewed by human eyes, the corners of the pixel portions 10*p* displaying black are interpolated by the human eyes. As a result, the edge Me viewed by the human eyes is blurred over a width W1 of the stepped portion. This width W1 is the direct cause of the blur of the moving image.

To reduce such blur, the liquid crystal device 1 according to the embodiment performs a display operation such that, as has been described with reference to FIG. 3, the luminance is different in two subframes obtained by dividing each frame. More specifically, a high-luminance display operation in which the luminance is higher than that of the original image signal and a low-luminance display operation in which the luminance is lower than that of the original image signal are performed within one frame.

As shown in FIG. 4, one frame is divided into two subframes, each subframe serving as a half frame, and, of the two subframes, the pixel portions 10*p* are allowed to perform a high-luminance display operation in one subframe period and a low-luminance display operation in the other subframe period. More specifically, an impulse display operation is performed in the subframes SFn2, SF(n+1)2, and SF(n+2)2, which are schematically indicated by slanted lines in FIG. 4. Therefore, the image signal processing circuit 170 sets, among the plurality of pixel portions 10*p*, the pixel portions 10*p* corresponding to the position of the edge Me of the moving object image M, the pixel portions 10*p* arranged in a line in the image display area 10*a*, or all the pixel portions 10*p* to low luminance. As a result, display advantages similar to those achieved in the case that a black image is inserted, as in the known art, can be achieved.

By performing such display operations, a width W2 of the edge Me becomes relatively narrower than the width W1 of the edge Me in the case that no subframe-basis display operation is performed. Therefore, blur of the edge Me is reduced from the width W1 to the width W2, and, hence, the blur of the moving image is reduced.

With continued reference to FIG. 4, the luminance of each pixel portion 10*p* performing a high-luminance display operation is set to be higher than that in the case that the frame images A and B are not separated into the subframe images A1, A2, B1, and B2 to be displayed. In contrast, the luminance of each pixel portion 10*p* displaying the subframe images A2 and B2 where a low-luminance display operation is performed is relatively lower than that in the case of each pixel portion 10*p* performing a high-luminance display operation. Therefore, the average luminance of the pixel portions 10*p* in each frame period, that is, the luminance perceived by human eyes, is maintained at a level in the case that the original frame image is perceived by human eyes. Accordingly, the brightness of the moving image displayed in the image display area 10*a* is maintained at a level similar to the case in which no frame is divided into subframes.

According to the liquid crystal device 1 of the depicted embodiment, the image signal processing circuit 170 displays images on a subframe basis with predetermined brightness, which is the brightness of each of the frame images A, B, . . . displayed on a frame-by-frame basis in corresponding frames in the image display area 10*a*, and sets the luminance of each pixel portion 10*p* in one subframe and in the other subframe of each frame to high luminance and low luminance, respectively. Accordingly, compared with the luminance of the original image signal, the brightness of an image displayed in the display area is not reduced. Furthermore, according to the liquid crystal device 1, moving image blur is significantly reduced as in the case where a black image is inserted. More specifically, within an area where the luminance of each pixel portion 10*p* changes, the width of an area interpolated by human eyes, that is, the width of an area serving as the direct cause of the moving image blur, can be narrowed. Because of the narrowed width, the moving image blur can be reduced.

According to the electro-optical device of the depicted embodiment, even in the case of a display operation performed in the hold mode, the brightness of a moving image can be maintained, and, at the same time, blur of the moving image can be reduced, which have been difficult to achieve using a known display method. Therefore, a high-quality moving image can be displayed.

As will be described next, with the processing operation of each circuit included in the liquid crystal device 1 shown in FIG. 1, from among the plurality of pixel portions 10*p* constituting the image display area 10*a*, only the pixel portions 10*p* defining the edge Me can be allowed to perform a low-luminance display operation. This case will be described in detail with reference to FIGS. 1 to 6.

Referring to FIGS. 1 and 3, the storage circuit 171 includes a first frame memory 171*a* and a second frame memory 171*b*. The second frame memory 171*b* obtains image data of the frame image A to be displayed in the n-th frame from the image signal Si and the synchronization signal Ss supplied from the video source 180 and temporarily stores the obtained image data. Next, the first frame memory 171*a* obtains image data of the frame image B to be displayed in the (n+1)-th frame and stores the image data. Next, the comparator circuit 173 reads the image data in the n-th frame and in the (n+1)-th frame from the first and second frame memories 171*a* and 171*b*. The comparator circuit 173 compares the luminance of each pixel portion 10*p* in the n-th frame with the luminance in the (n+1)-th frame.

In the case that, as a result of the comparison performed by the comparator circuit 1735 the determination circuit 172 determines that the difference in luminance of each pixel portion 10*p* between the n-th frame and the (n+1)-th frame is 10% or greater, for example, the image signal processing circuit 170 supplies image signals Sj1 and Sj2 obtained by integrating the image signal Si included in the image data in each of the n-th frame and the (n+1)-th frame with respect to a predetermined coefficient as image signals in the subframes Sn1 and SF2 to the data-line drive circuit 101.

More specifically, in the case that each frame image is divided into subframe images to be displayed, the predetermined coefficient is set such that each frame image composed of the subframe images has brightness similar to that in the case that each frame image is displayed on a frame-by-frame basis. For example, according to the embodiment, the image signal Sj1 is obtained by integrating the image signal Sj with respect to 1.3 serving as the predetermined coefficient, and the image signal Sj2 is obtained by integrating the image signal Sj with respect to 0.7 serving as the predetermined coefficient. Therefore, the brightness of each pixel portion 10*p* achieved by averaging the brightness of the two subframe images is equivalent to that in the case that a single frame image is displayed. Each pixel portion 10*p* displaying two subframe images of the (n+1)-th frame is allowed to display the subframe images on the basis of image signals processed in a similar manner, thereby maintaining the brightness of the frame image in the (n+1)-th frame.

In particular, as shown in FIG. 4, to allow only the pixel portions 10*p* defining the edge Me to perform a low-luminance display operation without displaying black linearly, among the plurality of pixel portions 10*p*, the pixel portions 10*p* having a luminance difference between the n-th frame and the (n+1)-th frame that is greater than or equal to a predetermined threshold are set to high luminance and low luminance. As a result, the predetermined pixel portions 10*p* are allowed to perform a low-luminance display operation in one of two subframes obtained by dividing one frame. The predetermined pixel portions 10*p* are pixel portions that display the edge Me of the moving object image M within the frame image displayed in each of one frame and the other frame. By setting the predetermined pixel portions 10*p* to high luminance and low luminance, the width of the edge Me perceived by human eyes can be narrowed compared with the case in which frame images are continuously displayed on a frame-by-frame basis. While the brightness of the moving image can be maintained, blur of the moving image can be reduced. In addition, the amount of data stored in the storage circuit 171 can be reduced, and hence, image signals can be processed at higher rates.

The predetermined coefficient is set by assigning one to a lower luminance level of two luminance levels having a difference greater than or equal to a predetermined threshold such as 10%. If a luminance exceeding the maximum luminance in a frame image is computed by integrating an image signal with respect to a predetermined coefficient greater than one, each pixel portion 10*p* is restricted to perform a display operation with the maximum luminance on the basis of an image signal obtained by integrating the image signal with the predetermined coefficient greater than one. By adopting zero and two as predetermined coefficients, two subframe images can be displayed, with a distinct luminance difference, by the pixel portions 10*p* performing a high-luminance display operation and a low-luminance display operation. In this way, blur of the edge Me can be reduced, and only the pixel portions 10*p* corresponding to the edge Me are allowed to perform a low-luminance display operation. The predetermined threshold is a reference value for determining, for example, whether blur of a moving image is recognized or not. For example, in the liquid crystal device 1, as has been described above, an exemplarily predetermined threshold is about 10% of the maximum voltage applied to liquid crystal held between the pixel electrode of each pixel portion 10*p* and the counter electrode. Needless to say, such a threshold can be set on the basis of the type of liquid crystal serving as an exemplary electro-optical material, that is, the relative relationship between the applied voltage and the alignment state of the liquid crystal. In addition, the predetermined threshold is set taking into consideration the degree of desired reduction in blur of a moving image.

The correction circuit 174 outputs corrected image signals Si1 and Si2 obtained by correcting image signals corresponding to the high luminance and the low luminance, respectively, to the display unit 10*c*. The correction circuit 174 can correct image signals corresponding to the high luminance and the low luminance, respectively, by referring to a gamma table, for example. Therefore, the number of bits of image signals can be reduced, compared with the case in which image signals processed according to the luminance to be displayed are generated in advance, and then image signals including a signal for displaying low luminance are generated according to the corresponding subframes.

Figure 6:
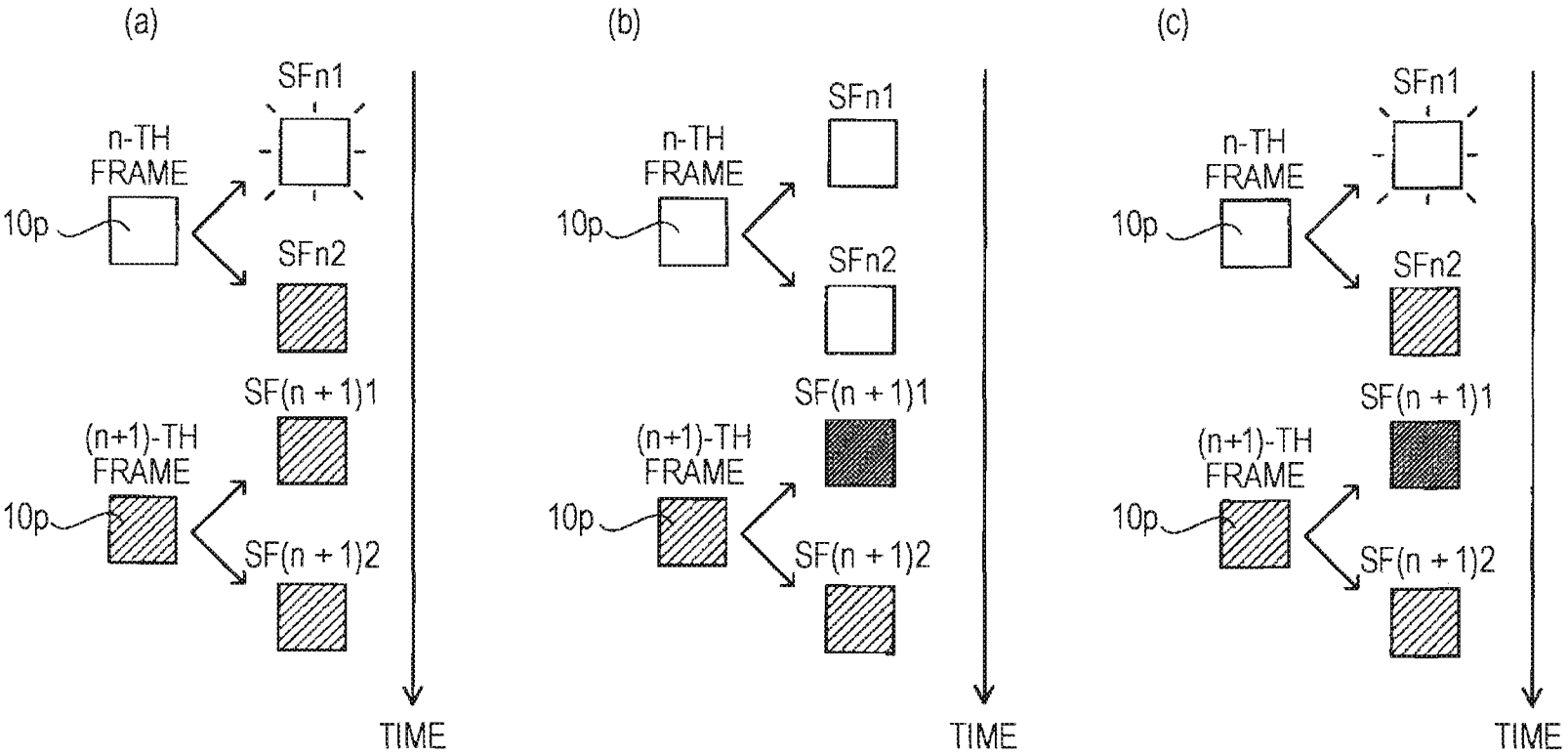
FIG. 6 includes diagrams showing a luminance combination set to one pixel portion in the subframes.

Referring now to FIG. 6, a combination of luminance levels set to one pixel portion 10*p* in the subframes will be described. FIG. 6 shows, for example, the case in which one pixel portion 10*p* performs a white display operation in the n-th frame and a low-luminance display operation in the (n+1)-th frame. That is, the pixel portion 10*p* performing a high-luminance display operation in the n-th frame and a low-luminance display operation in the (n+1)-th frame is a pixel portion displaying the edge Me of the moving object image M.

As shown in FIG. 6(*a*), the pixel portion 10*p* performing a high-luminance display operation in the n-th frame performs, in the subframe SFn1, a display operation with higher luminance than that in the high-luminance display operation to be performed in the n-th frame. In the subsequent subframe SFn2, the pixel portion 10*p* performs a low-luminance display operation with low luminance. The pixel portion 10*p* that should have performed the high-luminance display operation in the n-th frame performs a low-luminance display operation in the (n+1)-th frame. In this case, the pixel portion 10*p* performs a low-luminance display operation in two subframes SF(n+1)1 and SF(n+1)2 obtained by dividing the (n+1)-th frame. Since the pixel portion 10*p* performs a low-luminance display operation in the subframe SFn2, blur of the moving image perceived at the pixel portion 10*p* can be reduced.

As shown in FIG. 6(*b*), the pixel portion 10*p* performing a high-luminance display operation in the n-th frame performs, in the subframes SFn1 and SFn2, a display operation with luminance equivalent to that of the high-luminance display operation to be performed in the n-th frame. The pixel portion 10*p* performing the high-luminance display operation in the n-th frame performs, in the subframe SF(n+1)1, a dark display operation with luminance lower than that of a low-luminance display operation to be performed in the (n+1)-th frame. In the subframe SF(n+1)2, the pixel portion 10*p* performs a display operation with luminance equivalent to that to be displayed in the (n+1)-th frame. Since the pixel portion 10*p* performs a darker display operation in the subframe SF(n+1), the pixel portion 10*p* can display a moving image with reduced blur even in the hold mode, as in the impulse mode.

As shown in FIG. 6(*c*), the pixel portion 10*p* performing a high-luminance display operation in the n-th frame performs, in the subframe SFn1, a display operation with luminance higher than that to be displayed in the n-th frame, and the pixel portion 10*p* performs a low-luminance display operation in the subsequent subframe SFn2. In the subframe SF(n+1)1, the pixel portion 10*p* performs a darker display operation with luminance lower than that to be displayed in the (n+1)-th frame. In the subframe SF(n+1)2, the pixel portion 10*p* performs a display operation with luminance equivalent to that to be displayed in the (n+1)-th frame. Since the pixel portion 10*p* performs a display operation in the subframe SFn1 with luminance higher than that to be displayed in the n-th frame and a darker display operation in the subframe SF(n+1)1 than that to be displayed in the (n+1)-th frame, the pixel portion 10*p* can display a moving image with reduced blur even in the hold mode, as in the impulse mode.

As shown in portions (a) to (c) of FIG. 6, a plurality of display combinations in the subframes can be set.

The liquid crystal device 1 is a display device that can display color images. An image signal supplied from the video source 180 to the image signal processing circuit 170 is a color image signal composed of red (R), green (G), and blue (B) component signals. Color component signals of frame images in frames stored in the frame memories 171*a* and 171*b* of the storage circuit 171 contain image data corresponding to luminance of R, G, and B light. The comparator circuit 173 is provided for each of the R, G, and B color component signals included in each color image signal. The storage circuit 171 stores, for example, the color component signals included in the image signal Si in each of the n-th frame and the (n+1)-th frame. The comparator circuit 173 compares luminance of each color to be displayed by each pixel portion 10*p* in accordance with the color component signals stored in the storage circuit 171. On the basis of the comparison result obtained by the comparator circuit 173, the determination circuit 172 allows each pixel portion 10*p* to perform a dark display operation (that is, with luminance lower than that should have been displayed) in at least one of the n-th frame and the (n+1)-th frame for, among the R, G, and B colors, a color component that has a luminance difference greater than or equal to a predetermined threshold. Such a dark display operation is performed in at least one of the (n+1)-th frame and the (n+2)-th frame. That is, the image signal processing circuit 170 compares the color light components between two frame images displayed continuously and determines whether to allow each pixel portion 10*p* to perform a dark display operation.

Therefore, even in the case that the liquid crystal device 1 is a color display device, according to the liquid crystal device 1, blur of a moving image caused by a change in luminance of a specific one(s) of the R, G, and B light can be reduced.

In the case that a certain pixel portion 10*p* has, regarding at least one of the R, G, and B color component signals, a luminance difference between frame images displayed continuously (e.g., frame images displayed in the n-th frame and the (n+1)-th frame) that is greater than or equal to a predetermined threshold, the image signal processing circuit 170 may allow the certain pixel portion 10*p* to display a dark image regarding all the R, G, and B colors in a subframe of at least one of the n-th frame and the (n+1)-th frame. By controlling the pixel portion 10*p* to perform a dark display operation (that is, setting high luminance and low luminance to the pixel portion 10*p*) regarding color light whose luminance difference is greater than or equal to the predetermined threshold, blur of a moving image can be reduced, and the occurrence of a color shift induced in each frame image can be reduced.

Note that the image signal processing circuit 170 may allow the pixel portion 10*p* having a luminance difference greater than or equal to the predetermined threshold between consecutive frames regarding at least one of the R, G, and B color component signals to perform a dark display operation only for the color component signal with the luminance difference. By performing a dark display operation only for a specific color component, blur of a moving image can be reduced more or less.

Alternatively, the image signal processing circuit 170 may allow the pixel portion 10*p* having a luminance difference greater than or equal to the predetermined threshold regarding at least one of the R, G, and B color component signals to perform a dark display operation only for the remaining color component signals other than the color component signal with the luminance difference greater than or equal to the predetermined threshold. In this way, blur of a moving image caused by a change in luminance of color light corresponding to the remaining color component signals can be reduced.

Modification

Figure 7:
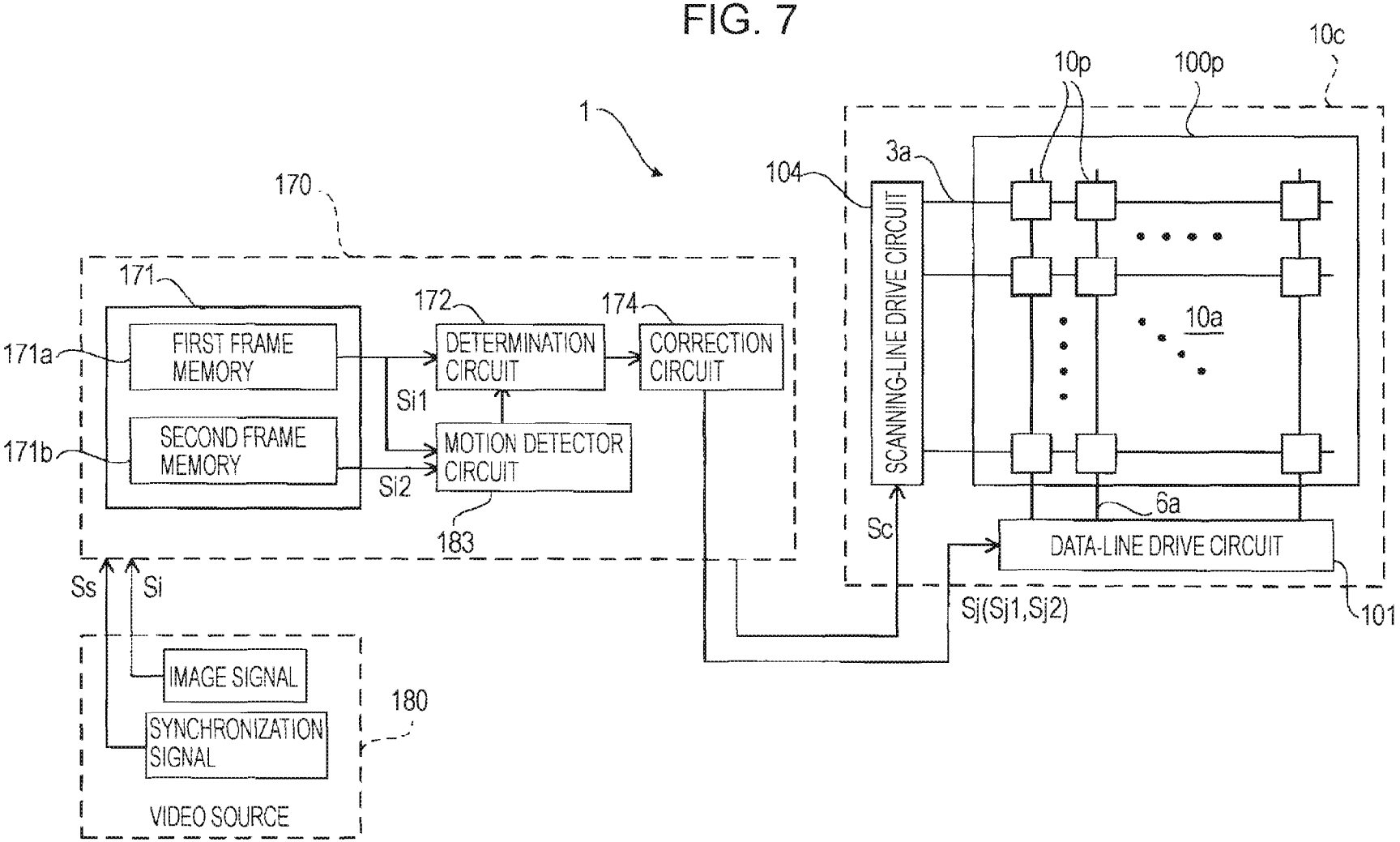
FIG. 7 is a block diagram of a modification of the liquid crystal device serving as the electro-optical device according to an embodiment of the invention.

Referring now to FIG. 7, a modification of the liquid crystal device 1 according to the embodiment of the invention will be described. FIG. 7 is a block diagram of the liquid crystal device 1 according to the modification. In the following description, portions corresponding to those of the above-described liquid crystal device 1 are given the same reference numerals, and detailed descriptions thereof are omitted.

Referring to FIG. 7, the image signal processing circuit 170 includes the storage circuit 171, the determination circuit 172, a motion detector circuit 183, and the correction circuit 174.

The storage circuit 171 includes the first frame memory 171*a* and the second frame memory 171*b*. The first frame memory 171*a* and the second frame memory 171*b* store an image signal of a frame image to be displayed in a first frame and an image signal of a frame image to be displayed in a second frame that precedes or follows the first frame. More specifically, the first frame memory 171*a* and the second frame memory 171*b* store image signals in, for example, the n-th frame and the (n+1)-th frame.

The motion detector circuit 183 detects the motion of the moving object image M displayed in a series of frames including the first and second frames in the image display area 10*a* on the basis of the image signals stored in the frame memories 171*a* and 171*b*. The motion detector circuit 183 uses a known motion detection method to detect the motion of the moving object image M within the frame images.

The image signal processing circuit 170 allows, among the plurality of pixel portions 10*p*, the pixel portions 10*p* that display the motion of the moving object image M, which is detected by the motion detector circuit 183, to display a dark image. More specifically, a dark image is displayed in one of subframes of at least one of the consecutive frames. The pixel portions 10*p* displaying a dark image are pixel portions corresponding to the edge Me of the moving object image M.

According to the liquid crystal device 1 of the modification, an image can be displayed in a manner similar to the impulse display mode, as in the above-described case in which the comparator is used, and hence, blur of the moving image can be reduced. Furthermore, a reduction in luminance of the image display area 10*a* can be suppressed.

Overall Structure of Electro-Optical Device

Figure 8:
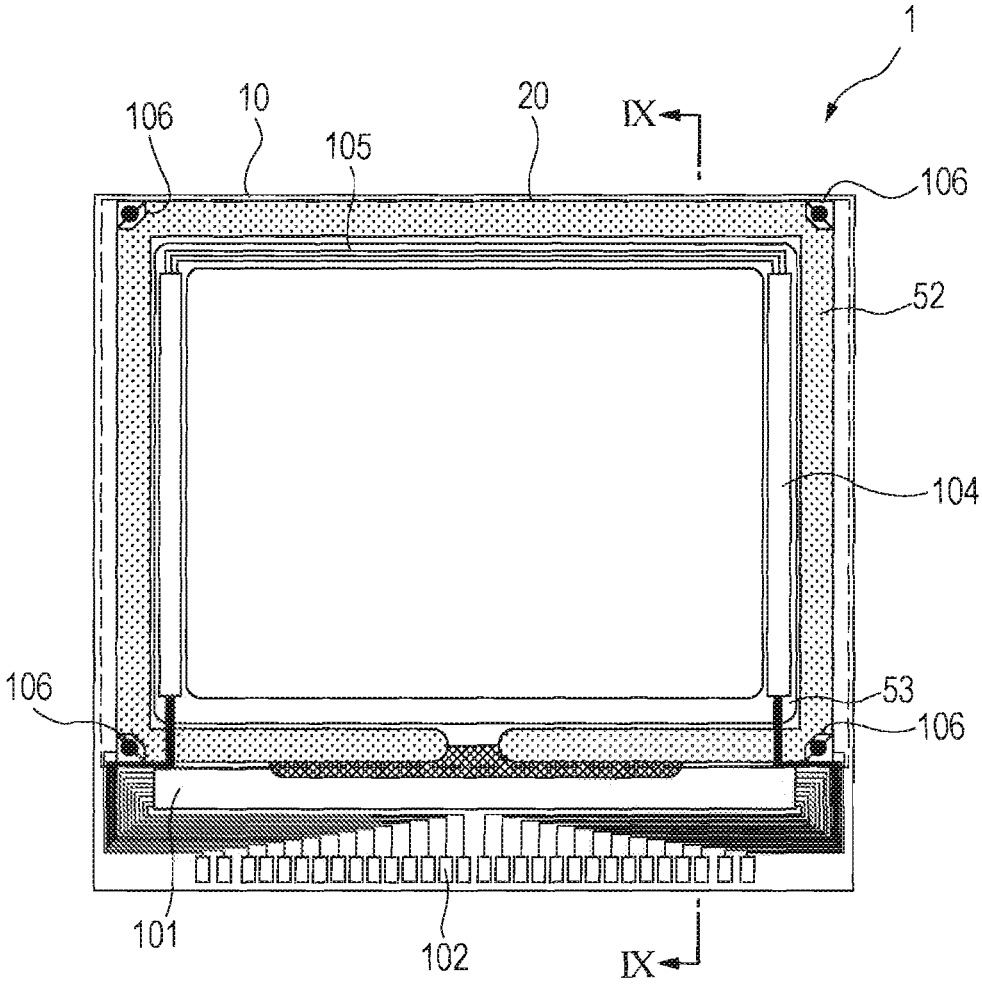
FIG. 8 is a plan view of the liquid crystal device serving as the electro-optical device according to an embodiment of the invention.
Figure 9:
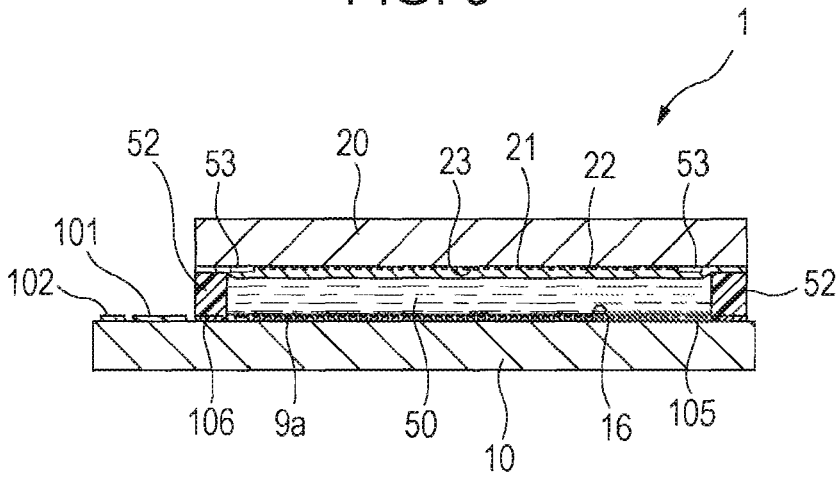
FIG. 9 is a sectional view taken along the line IX-IX.

Referring now to FIGS. 8 and 9, the overall structure of the liquid crystal device 1 according to the embodiment will be described. FIG. 8 is a plan view of an electro-optical device in which a TFT array substrate on which elements are formed is viewed from a counter substrate. FIG. 9 is a sectional view taken along the line IX-IX of FIG. 8. In this case, a liquid crystal device in a TFT active matrix drive mode, which includes built-in drive circuits, will be described as an exemplary electro-optical device.

Referring to FIGS. 8 and 9, the liquid crystal device 1 includes a TFT array substrate 10 and a counter substrate 20, which are disposed to face each other. A liquid crystal layer 50 is sealed between the TFT array substrate 10 and the counter substrate 20. The TFT array substrate 10 and the counter substrate 20 are bonded to each other by a sealant 52 provided in a seal area located around the image display area 10*a*.

The sealant 52 is composed of, for example, an ultraviolet curable resin, a heat curable resin, or the like for bonding the two substrates 10 and 20 with each other. The sealant 52 is applied on the TFT array substrate 10 in a manufacturing process and then cured by ultraviolet irradiation or heating. The sealant 52 contains gap materials, such as glass fibers or glass beads, dispersed therein for obtaining a predetermined gap (inter-substrate gap) between the TFT array substrate 10 and the counter substrate 20. In other words, the electro-optical device according to the embodiment is useful for compact and enlargement display applications, e.g., a light valve of a projector.

A frame light-shielding film 53 is disposed on the counter substrate 20 so as to define a frame area of the image display area 10*a* along the inner periphery of the seal area in which the sealant 52 is disposed. Note that part or all of the frame light-shielding film 53 may be disposed on the TFT array substrate 10 as an internal light-shielding film. In a peripheral area beyond the light-shielding film 53, the data-line drive circuit 10 and external circuit connection terminals 102 are disposed along one side of the TFT array substrate 10 outside the seal area in which the sealant 52 is disposed. Scanning-line drive circuits 104 are also disposed along two sides adjacent to the side along which the data-line drive circuit 101 and the external circuit connection terminals 102 are disposed. The scanning line driving circuits 104 are covered with the frame light-shielding film 53. A plurality of lines 105 for connecting between the two scanning line driving circuits 104 disposed along two sides of the image display area 10*a* are disposed along the remaining side of the TFT array substrate 10. The lines 105 are covered with the frame light-shielding film 53.

Conducting members 106 serving as conducting terminals between the two substrates 10 and 20 are disposed at four corners of the counter substrate 20. In contrast, conducting terminals are disposed on the TFT array substrate 10 at positions facing the four corners of the counter substrate 20. These conducting members 106 and terminals allow electrical conduction between the TFT array substrate 10 and the counter substrate 20.

Referring to FIG. 9, pixel switching TFTs and lines, such as scanning lines and data lines, are formed on the pixel electrodes 9*a* on the TFT array substrate 10, and are coated with an alignment film. In contrast, a counter electrode 21 and a lattice-shaped or stripe-shaped light-shielding film 23 are formed on the counter substrate 20, and are coated with an alignment film. The liquid crystal layer 50 is made of, for example, one kind of nematic liquid crystal or a mixture of several kinds of nematic liquid crystal, and is aligned in a predetermined state between the pair of alignment films.

Besides the data-line drive circuit 101, the scanning-line drive circuits 104, and the like, the TFT array substrate 10 shown in FIGS. 8 and 9 may also have a sampling circuit for sampling image signals on image signal lines and supplying sampled image signals to the data lines, a pre-charge circuit for supplying pre-charge signals having predetermined voltage levels to the data lines prior to the image signals, an inspection circuit for inspecting the quality, defects, and the like of the electro-optical device during manufacturing or at the time of shipment.

Electronic Apparatus

Figure 10:
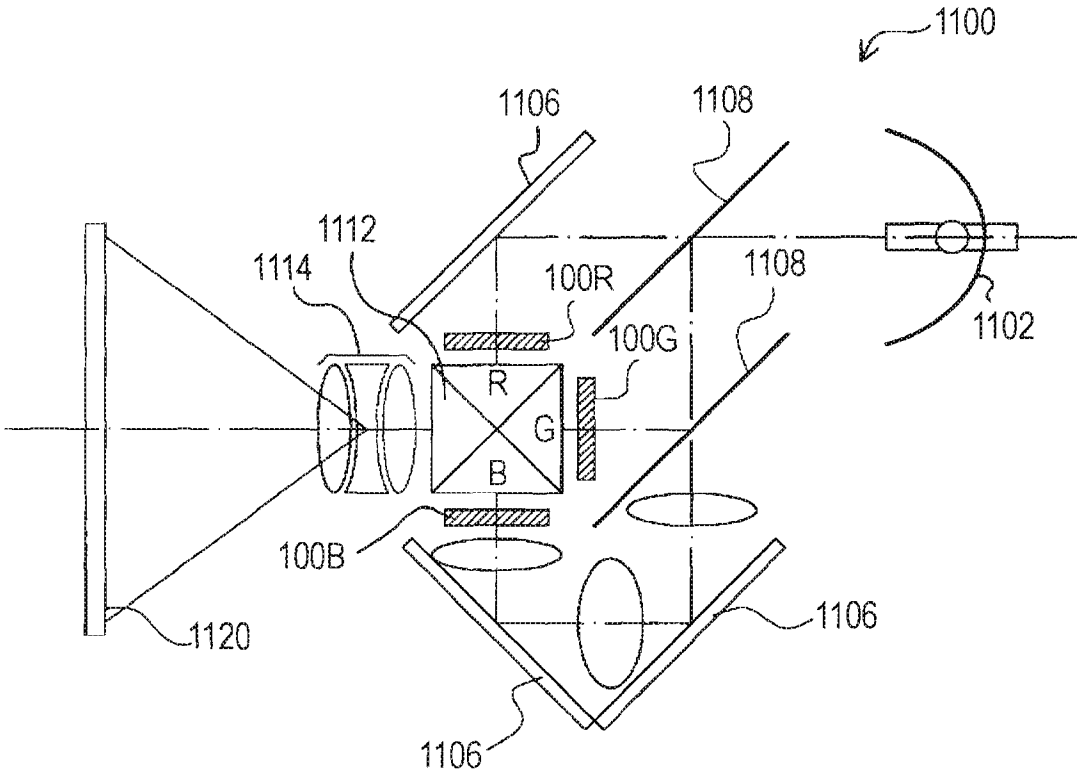
FIG. 10 is a sectional view showing the structure of a liquid crystal projector serving as an electronic apparatus according to an embodiment of the invention.

Next, the case in which the above-described liquid crystal device 1 is applied to an electronic apparatus will be described. In this case, a projector using the liquid crystal device 1 as a light valve will be described. FIG. 10 is a plan view showing an exemplary structure of the projector.

In a projector 1100, as shown in FIG. 10, a lamp unit 1102 including a white light source, such as a halogen lamp, is disposed. Projection light emitted from the lamp unit 1102 is separated into three (R, G, and B) primary colors by four mirrors 1106 and two dichroic mirrors 1108, which are disposed in a light guide, and the R, G, and B color light components enter liquid crystal devices 100R, 100G, and 100B serving as light valves corresponding to the R, G, and B primary colors, respectively. The structure of the liquid crystal devices 100R, 100G, and 100B is equivalent to that of the above-described liquid crystal device. The liquid crystal devices 100R, 100G, and 100B modulate R, G, and B primary color signals, respectively, which are supplied from the image signal processing circuit 170. The light components modulated by these liquid crystal devices 100R, 100G, and 100B enter a dichroic prism 1112 from three directions. In the dichroic prism 1112, the R and B light components are refracted at 90 degrees, while the G light component passes directly through the dichroic prism 1112. As a result, R, G, and B color images are combined, and a color image is projected onto a screen 1120 or the like through a projection lens 1114.

Although the liquid crystal device has been described as an exemplary electro-optical device according to the embodiment of the invention, the electro-optical device according to the embodiment of the invention can be implemented as, for example, an electrophoretic device, such as electronic paper, or a display device using electron-emitting elements (e.g., a field emission display or a surface-conduction electron-emitter display). The electro-optical device according to the embodiment of the invention is applicable to various electronic apparatuses including, besides the above-described projector, a television receiver, a viewfinder-type or monitor direction-view type videotape recorder, a car navigation system, a pager, a digital diary, a calculator, a word-processor, a workstation, a videophone, a POS terminal, and an apparatus equipped with a touch panel.

The present invention is not limited to the embodiments described above. Various changes, alterations, and modifications are possible without departing from the scope or spirit of the invention set forth in claims and the entire specification. An electro-optical device with such modifications, an image processing circuit, and an electronic apparatus including the electro-optical device are also included in the technical scope of the invention.

What is claimed is:

1. An electro-optical device comprising:

a display unit that has a plurality of pixel portions; and an image signal processing circuit that generates, for a first pixel portion of the plurality of pixel portions, a first image signal and a second image signal, the first pixel portion including a pixel electrode and a thin-film transistor for switching on and off the pixel electrode, the first pixel portion having a luminance difference between an n-th frame and an m-th frame, a difference between the m and n being one, the luminance difference being greater than or equal to a predetermined threshold, the first image signal setting a luminance of the first pixel portion in a first subframe of the m-th frame higher than a first frame luminance, the first frame luminance being a luminance to be displayed in the first pixel portion in the m-th frame by an original image signal, the second image signal setting a luminance of the first pixel portion in a second subframe of the m-th frame lower than the first luminance, wherein the image signal processing circuit includes:

a storage unit that stores the first frame luminance and a second frame luminance, the second frame luminance being a luminance displayed in the first pixel portion in the n-th frame;

a comparator that compares the first frame luminance with the second frame luminance, the first frame luminance and the second frame luminance being stored in the storage unit; and a determination unit that determines whether a difference between the first frame luminance and the second frame luminance is greater than or equal to the predetermined threshold, and wherein a color image signal including red, green and blue color component signals is supplied to the image signal processing circuit, the comparator is provided for each of the red, green, and blue color component signals included in the color image signal, and in the case that the difference between the first frame luminance and the second frame luminance of at least one of the red, green, and blue color component signals is greater than or equal to the predetermined threshold, the image signal processing circuit setting the luminance of the first subframe and the luminance of the second subframe to the first pixel portion regarding all the red, green, and blue color component signals.

2. The electro-optical device according to claim 1, the image signal processing circuit including a signal correction unit that outputs corrected image signals to the display unit, the corrected image signals being obtained by correcting image signals corresponding to the luminance of the first subframe and the luminance of the second subframe, respectively.

3. An image processing circuit comprising:

an image signal processing circuit that generates, for a first pixel portion in a display area of a display unit including a plurality of pixel portions arranged on a substrate, a first image signal and a second image signal, the first pixel portion including a pixel electrode and a thin-film transistor for switching on and off the pixel electrode, the first pixel portion having a luminance difference between an n-th frame and an m-th frame, a difference between the m and n being one, the luminance difference being greater than or equal to a predetermined threshold; and a driver that drives the display unit in accordance with the first image signal and the second image signal, the first image signal setting a luminance of the first pixel portion in a first subframe of the m-th frame higher than a first frame luminance, the first frame luminance being a luminance to be displayed in the first pixel portion in the m-th frame by an original image signal, the second image signal setting a luminance of the first pixel portion in a second subframe of the m-th frame lower than the first frame luminance, wherein the image signal processing circuit includes:

a storage unit that stores the first frame luminance and a second frame luminance, the second frame luminance being a luminance displayed in the first pixel portion in the n-th frame;

a comparator that compares the first frame luminance with the second frame luminance, the first frame luminance and the second frame luminance being stored in the storage unit; and a determination unit that determines whether a difference between the first frame luminance and the second frame luminance is greater than or equal to the predetermined threshold, and wherein a color image signal including red, green and blue color component signals is supplied to the image signal processing circuit, the comparator is provided for each of the red, green, and blue color component signals included in the color image signal, and in the case that the difference between the first frame luminance and the second frame luminance of at least one of the red, green, and blue color component signals is greater than or equal to the predetermined threshold, the image signal processing circuit setting the luminance of the first subframe and the luminance of the second subframe to the first pixel portion regarding all the red, green, and blue color component signals.

4. An electronic apparatus comprising:

a housing, and the electro-optical device as set forth in claim 1 accommodated by the housing.

5. An electro-optical device comprising:

a display unit including a pixel portion that displays a first frame of an image, the pixel portion having a first frame luminance, the pixel portion including a pixel electrode and a thin-film transistor for switching on and off the pixel electrode; and an image signal processing circuit that partitions the frame into a first subframe with a first luminance and a second subframe with a second luminance, and generates, for the pixel portion, a first image signal and a second image signal, the pixel portion having a luminance difference between an n-th frame and an m-th frame, a difference between the m and n being one, the luminance difference being greater than or equal to a predetermined threshold, the first image signal setting the first luminance of the pixel portion of the m-th frame higher than the first frame luminance, the first frame luminance being a luminance to be displayed in the pixel portion in the m-th frame by an original image signal, the second image signal setting the second luminance of the pixel portion of the m-th frame lower than the first frame luminance, and wherein the image signal processing circuit includes:

a storage unit that stores the first frame luminance and a second frame luminance, the second frame luminance being a luminance displayed in the first pixel portion in the n-th frame;

a comparator that compares the first frame luminance with the second frame luminance, the first frame luminance and the second frame luminance being stored in the storage unit; and a determination unit that determines whether a difference between the first frame luminance and the second frame luminance is greater than or equal to the predetermined threshold, and wherein a color image signal including red, green and blue color component signals is supplied to the image signal processing circuit, the comparator is provided for each of the red, green, and blue color component signals included in the color image signal, and in the case that the difference between the first frame luminance and the second frame luminance of at least one of the red, green, and blue color component signals is greater than or equal to the predetermined threshold, the image signal processing circuit setting the luminance of the first subframe and the luminance of the second subframe to the first pixel portion regarding all the red, green, and blue color component signals.

* * * * *